US012571385B2

(12) United States Patent
Helmig

(10) Patent No.: US 12,571,385 B2
(45) Date of Patent: Mar. 10, 2026

(54) HIGH-PRESSURE PLUNGER PUMP, AND USE OF A HIGH-PRESSURE PLUNGER PUMP

(71) Applicant: HAMMELMANN GMBH, Oelde (DE)

(72) Inventor: Burkhard Helmig, Beckum (DE)

(73) Assignee: Hammelmann GmbH, Oelde (DE)

( * ) Notice: Subject to any disclaimer, the term of this patent is extended or adjusted under 35 U.S.C. 154(b) by 126 days.

(21) Appl. No.: 18/292,374

(22) PCT Filed: May 5, 2022

(86) PCT No.: PCT/EP2022/062195
§ 371 (c)(1),
(2) Date: Jan. 26, 2024

(87) PCT Pub. No.: WO2023/006270
PCT Pub. Date: Feb. 2, 2023

(65) Prior Publication Data

US 2024/0344507 A1 Oct. 17, 2024

(30) Foreign Application Priority Data

Jul. 29, 2021 (DE) ..... 10 2021 119 690.6

(51) Int. Cl.
*F04B 49/03* (2006.01)
*F04B 7/02* (2006.01)
(Continued)

(52) U.S. Cl.
CPC ..... *F04B 49/03* (2013.01); *F04B 7/0266* (2013.01); *F04B 17/00* (2013.01); *F04B 53/006* (2013.01)

(58) Field of Classification Search
CPC ..... F04B 49/03; F04B 7/0266; F04B 17/00; F04B 53/006
See application file for complete search history.

(56) References Cited

U.S. PATENT DOCUMENTS 8,667,792 B2 * 3/2014 McBride ..... F02G 1/043 60/659
9,109,614 B1 * 8/2015 Fong ..... F15B 1/024
(Continued)

FOREIGN PATENT DOCUMENTS

DE 102016124422 A1 6/2018
EP 3201474 B1 10/2020
(Continued)

OTHER PUBLICATIONS

International Search Report and Written Opinion mailed Sep. 6, 2022 in related/corresponding International Application No. PCT/EP2022/062195.
(Continued)

*Primary Examiner* — Nathan C Zollinger
(74) *Attorney, Agent, or Firm* — PATENT PORTFOLIO BUILDERS PLLC

(57) ABSTRACT

A high-pressure plunger pump includes a plunger assembly having a working chamber and a plunger positioned in the working chamber that is movable in an axial direction, as we as first and second control valves connected to a valve housing having at least one high-pressure line and at least one low-pressure line, which are respectively connected to the working chamber by first and second control valves. The valve housing having a high-pressure connection that opens into the high-pressure line. The first and second control valves are actuable by a control unit in such a way that a fluid, which is fed via the high-pressure connection of the valve housing and is under high pressure, is fed to the working chamber and is dischargeable via a low-pressure connection of the suction valve after driving the plunger. The plunger is coupled to a generator via a driveshaft.

10 Claims, 5 Drawing Sheets

Figure 1:
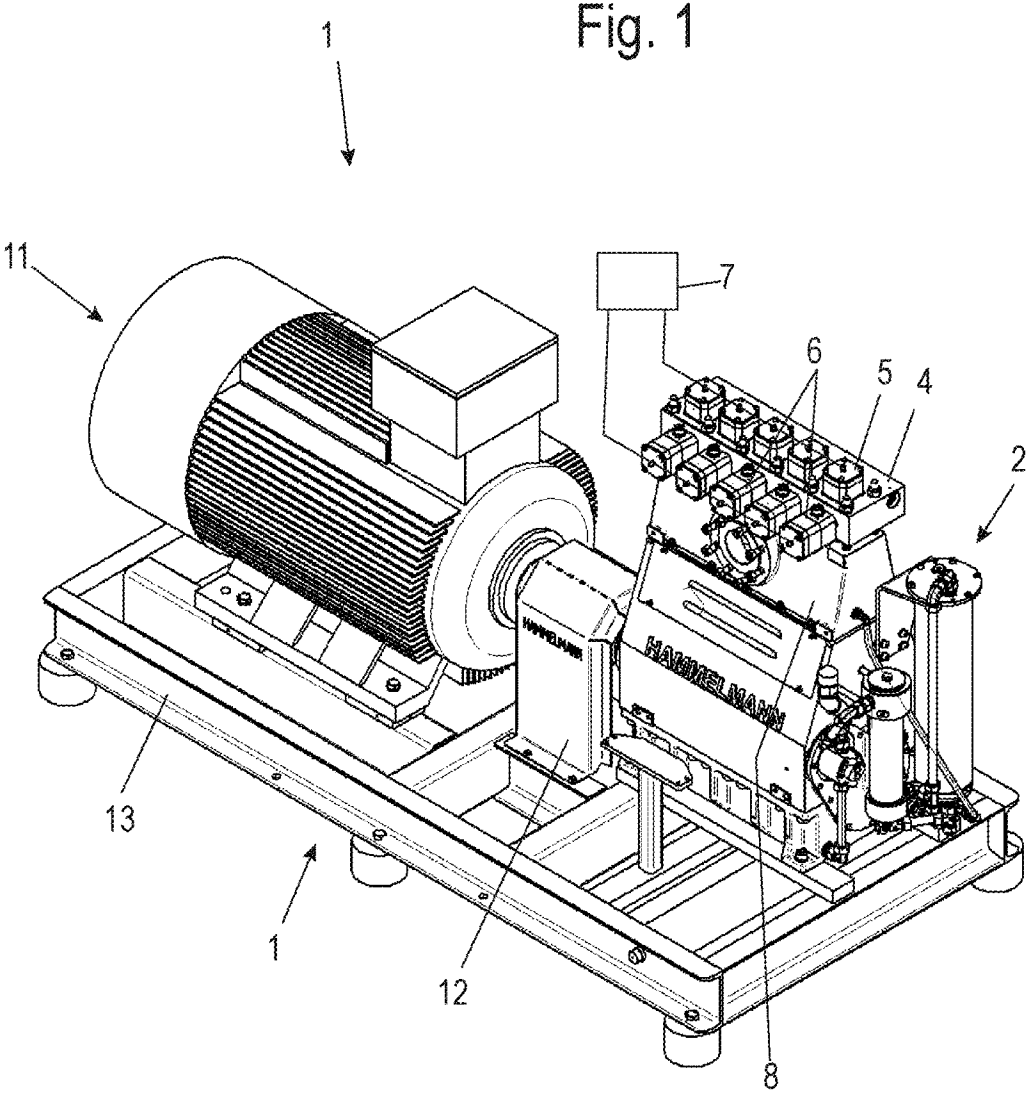

(51) Int. Cl.
*F04B 17/00* (2006.01)
*F04B 53/00* (2006.01)

(56) References Cited

U.S. PATENT DOCUMENTS

| | | | | |
|---|---|---|---|---|
| 10,180,135 | B2 * | 1/2019 | Caldwell | F15B 7/006 |
| 11,059,547 | B2 * | 7/2021 | Kristjansson | E21B 19/006 |
| 11,686,304 | B2 * | 6/2023 | Takahashi | F04B 39/0094 417/440 |

FOREIGN PATENT DOCUMENTS

| | | | |
|---|---|---|---|
| JP | 2012067749 | A | 4/2012 |
| JP | 2013148141 | A | 8/2013 |
| JP | 2014152609 | A | 8/2014 |
| JP | 2017531769 | A | 10/2017 |

OTHER PUBLICATIONS

Office Action dated Dec. 23, 2025 in related/corresponding JP Application No. 2024-504963.

* cited by examiner

HIGH-PRESSURE PLUNGER PUMP, AND USE OF A HIGH-PRESSURE PLUNGER PUMP

BACKGROUND AND SUMMARY OF THE INVENTION

Exemplary embodiments of the present invention relate to a high-pressure plunger pump according and to the use of such a high-pressure plunger pump.

A generic high-pressure plunger pump is known, for example, from DE 10 2016 124 422 A1.

Generic high-pressure plunger pumps are used to generate working pressures of up to 4000 bar. For this purpose, the high-pressure plunger pump has one or more oscillatingly drivable plungers, wherein each of the plungers draws a volume of fluid into a working chamber of the plunger pump via a control valve designed as a suction valve and discharges it under high pressure through an outlet valve. The plunger is driven by a driveshaft that can be driven by a drive device, for example by an electric motor.

Such high-pressure plunger pumps have proven themselves in practice.

Exemplary embodiments of the present invention are directed to adapting a generic high-pressure plunger pump for a further field of application.

The high-pressure plunger pump according to the invention has at least one plunger arrangement with a working chamber and a plunger arranged to move axially back and forth in the working chamber.

The high-pressure plunger pump also has at least one first control valve and at least one second control valve, wherein the two control valves are connected to a valve housing having at least one high-pressure line and at least one low-pressure line.

The high-pressure line is connected to the working chamber in a sealable manner by the first control valve. The low-pressure line is connected to the working chamber in a sealable manner by the second control valve. The valve housing has a high-pressure connection that opens into the high-pressure line.

The at least one first control valve and the at least one second control valve can be actuated via a control unit in such a way that a fluid, which is supplied via the high-pressure connection of the valve housing and is under high pressure, can be supplied to the working chamber and can be discharged via a low-pressure connection of the at least one second control valve after the plunger has been driven, wherein the at least one plunger is coupled to a generator via a driveshaft.

With the high-pressure plunger pump according to the invention, the design of the control valves as separately controllable control valves via the control unit makes it possible to use the high-pressure plunger pump for energy recovery.

Instead of, or in addition to, providing a fluid under high pressure, the control of the control valves according to the invention can be used to virtually reverse the mode of operation of the high-pressure plunger pump, so that a fluid under high pressure can be fed via the high-pressure line into the working chamber of the high-pressure plunger pump, thereby driving the at least one plunger, which in turn is coupled via a driveshaft to a generator, via which at least some of the expansion energy generated during pressure-reducing processes can be recovered.

According to an advantageous embodiment variant, at least three, in particular five, plunger arrangements are provided, each with one plunger, wherein each of the plungers is assigned a first control valve and a second control valve.

The arrangement of at least three plunger arrangements with separately controllable control valves enables simple and reliable operation of the high-pressure plunger pump to drive the generator.

According to a further embodiment variant, the at least one first control valve and the at least one second control valve can be operated by the control unit both as an inlet valve and as an outlet valve. The generator can preferably also be operated as a motor.

This allows the high-pressure plunger pump to be used in a pressure regulation system, for example, in which the high-pressure plunger pump generates the necessary working pressure in the working fluid and provides a process assembly and, secondly, is able to absorb excess high pressure from the process assembly and convert the expansion energy into electrical energy instead of discharging the expansion energy unused to the outside via a drain valve.

According to an advantageous embodiment variant, the control valves can be actuated pneumatically, electrically, or hydraulically.

According to a preferred embodiment variant, the control unit is coupled to one or more sensors, each of which provides one or more operating parameter data of the high-pressure plunger pump, in particular the rotational position of the driveshaft, a pressure of a fluid in the high-pressure line and/or the low-pressure line.

Providing these operating parameters ensures improved control of the control valves by the control unit.

According to a preferred embodiment, the control unit has at least one data interface for recording external operating parameter data, in particular of a process assembly upstream of the high-pressure plunger pump.

Such external operating parameter data can be, for example, the system pressure of the upstream process.

According to a further embodiment variant of the high-pressure plunger pump, this has a second plunger arrangement with a working chamber and a plunger arranged to move axially back and forth in the working chamber, as well as at least one pressure valve and at least one suction valve, which are connected to a valve housing with at least one high-pressure line and at least one low-pressure line.

The high-pressure line is connected to the working chamber in a sealable manner by the pressure valve and the low-pressure line is connected to the working chamber in a sealable manner by the suction valve, wherein the at least one plunger is coupled to a third driveshaft via a second driveshaft, wherein the third driveshaft is also coupled to the first driveshaft.

This design of the high-pressure plunger pump enables the pressure of the working fluid to be increased in use by the second plunger arrangement, wherein the energy for driving the plungers of the second plunger arrangement can be at least partially or completely taken from the expansion of the high-pressure working fluid introduced into the first plunger arrangement, which drives the first driveshaft and can be transmitted to the second driveshaft by coupling via the third driveshaft.

The use according to the invention of a high-pressure plunger pump for pressure regulation in a hydraulic process assembly is characterized in that the high-pressure plunger pump is designed according to one of the embodiments above, wherein the high-pressure plunger pump is coupled to the process assembly such that in pumping operation the high-pressure plunger pump supplies a fluid at a predetermined high pressure to the process assembly, wherein the control valves are controlled via the control unit such that the at least one plunger is driven by a motor-driven driveshaft.

In motor operation of the high-pressure plunger pump, the fluid is supplied at the predetermined high pressure via the high-pressure line and the control valves are controlled via the control unit in such a way that the driveshaft is driven by the at least one plunger, wherein the driveshaft is coupled to a generator to generate electricity.

In a further use of a high-pressure plunger pump for pressure regulation in a hydraulic process assembly, in which the high-pressure plunger pump is designed as described above, the high-pressure plunger pump is coupled to the process assembly such that the fluid is supplied to the high-pressure plunger pump at a high pressure predetermined by the hydraulic process assembly via the high-pressure line and the control valves are controlled via the control unit in such a way that the driveshaft is driven by the at least one plunger, wherein the driveshaft is coupled to a generator to generate electricity.

One such use is provided as a replacement for a pressure relief valve, for example, wherein the excess high pressure in such a pressure relief valve is released unused into the environment, while the use of the high-pressure plunger pump means that this excess pressure is used for energy recovery via the high-pressure plunger pump.

BRIEF DESCRIPTION OF THE DRAWING FIGURES

Figure 2:
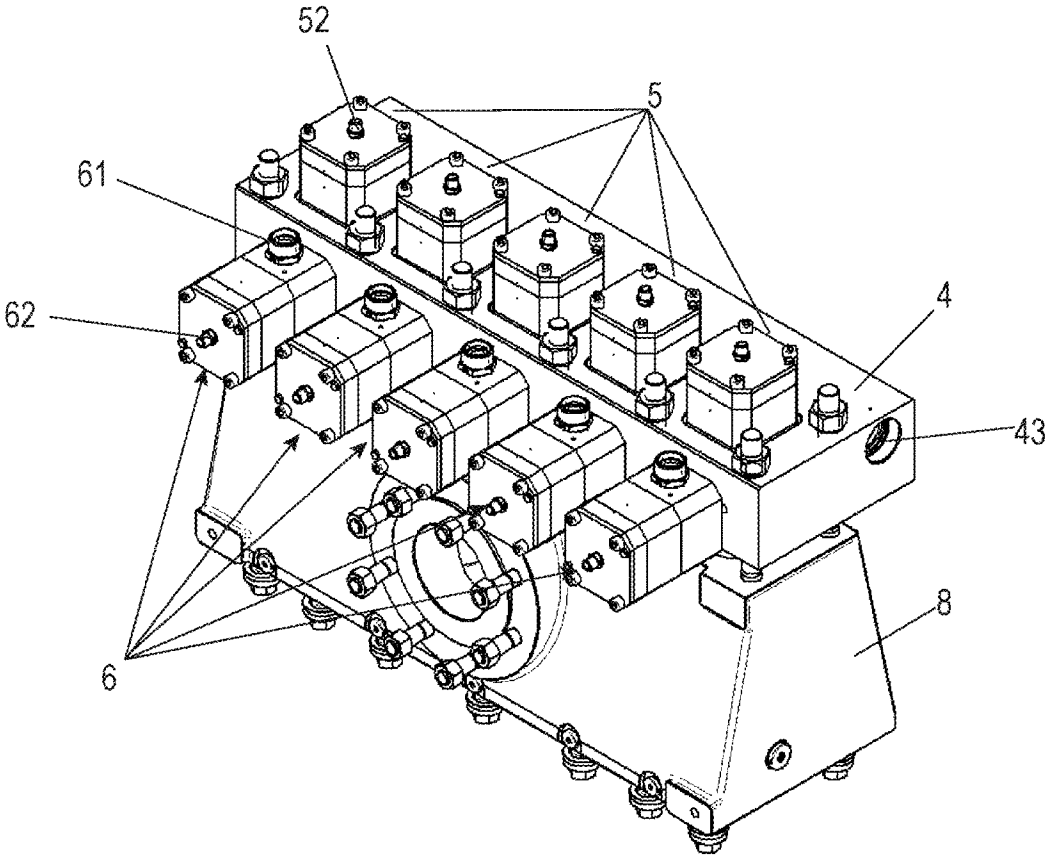
Figure 3:
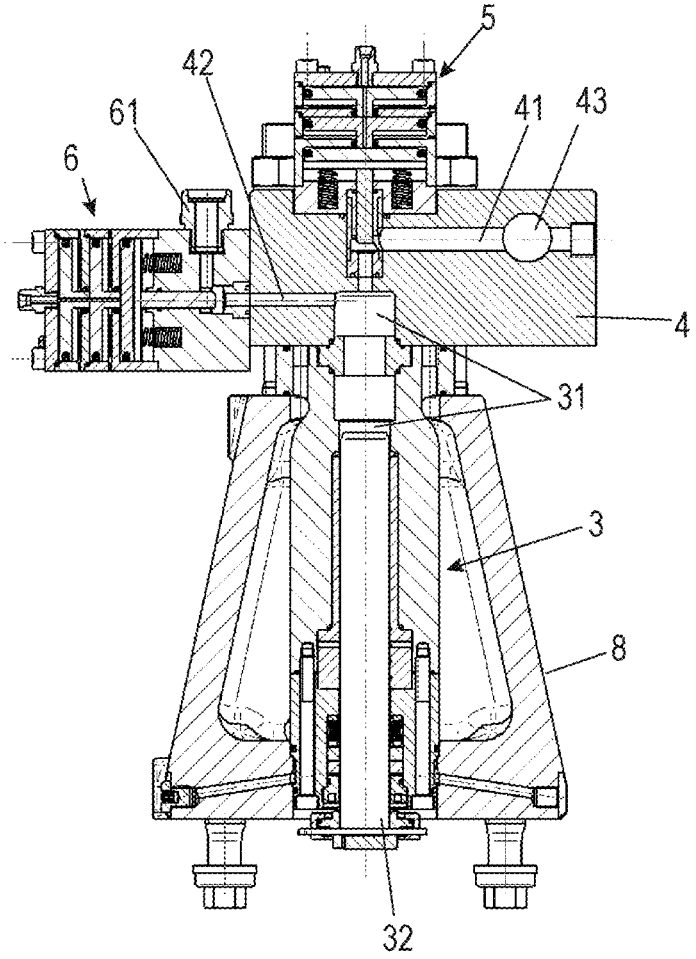
Figure 4:
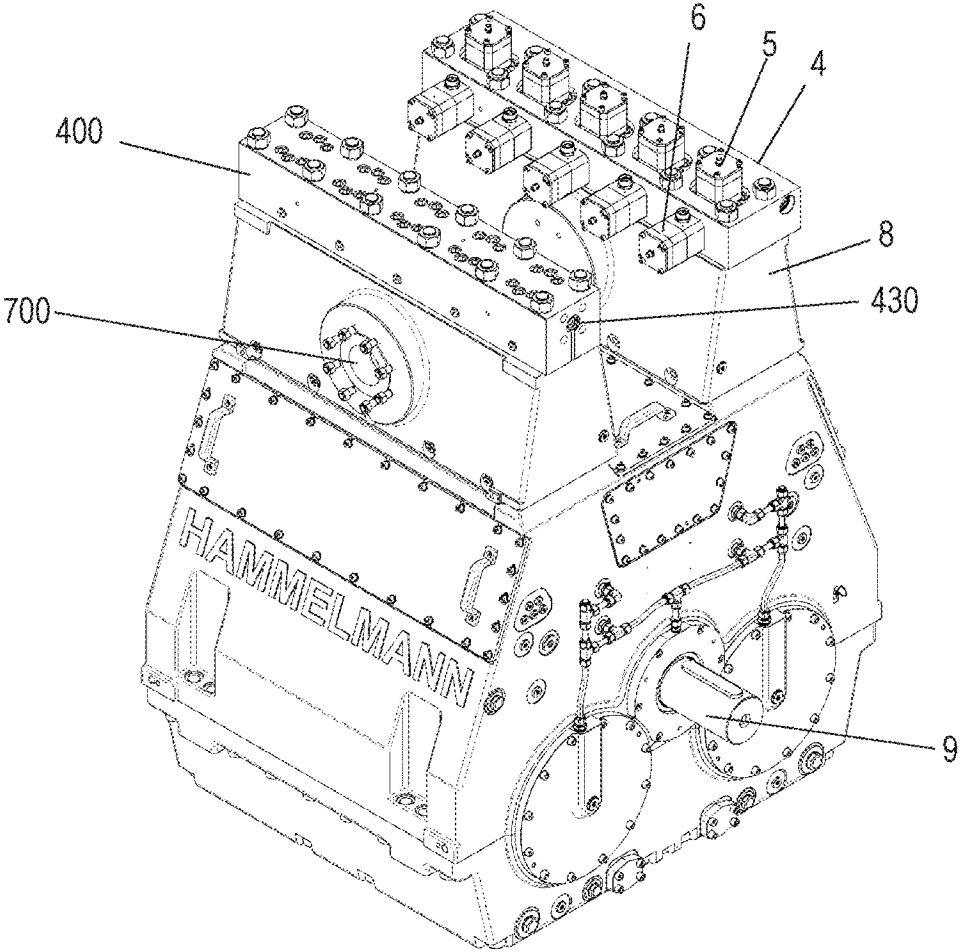
Figure 5:
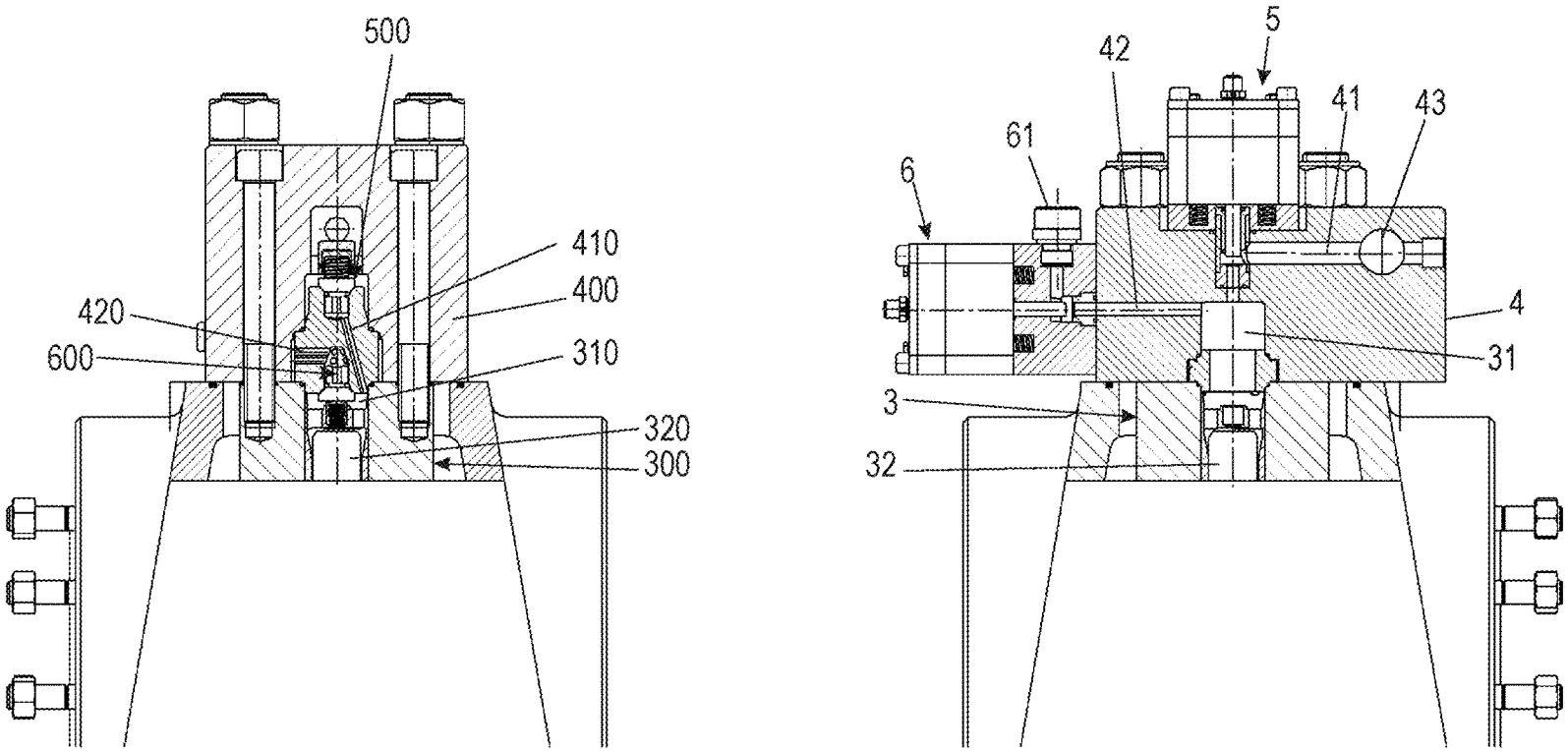

In the following, preferred exemplary embodiments are explained in more detail with reference to the accompanying drawings, wherein:

FIG. 1 shows a schematic isometric representation of an energy recovery arrangement with a high-pressure plunger pump, FIG. 2 shows an isometric representation of a plunger arrangement with a valve housing arranged on it with separately controllable control valves, FIG. 3 shows a sectional view through a plunger arrangement, FIG. 4 shows a schematic isometric representation of a further design variant of a high-pressure plunger pump, and FIG. 5 shows a sectional view through the plunger arrangement of the high-pressure plunger pump shown in FIG. 4.

DETAILED DESCRIPTION

In the following description of the figures, terms such as top, bottom, left, right, front, rear, etc. refer exclusively to the exemplary representation and position of the high-pressure plunger pump, plunger, working chamber, valve housing, control valve, generator and the like selected in the respective figures. These terms are not to be understood restrictively, i.e., these references may change due to different working positions or the mirror-symmetrical design or the like.

In FIG. 1, the reference sign 1 is used to designate a variant of an energy recovery arrangement.

The central component of this energy recovery arrangement 1 is a high-pressure plunger pump 2, which is coupled to a generator 11 via a first driveshaft, preferably with the interposition of a clutch 12. A frame 13 of the energy recovery arrangement 1 serves to secure the high-pressure plunger pump 2, the clutch 12, and the generator 11.

In the exemplary embodiment shown, the high-pressure plunger pump 2 has five plunger arrangements 3, each with a working chamber 31 and a plunger 32 arranged to move axially back and forth in the working chamber 31, as shown as an example in the sectional view in FIG. 3.

In principle, a high-pressure plunger pump 2 with only one such plunger arrangement 3 is also conceivable.

A first control valve 5 and a second control valve 6, which are connected to a valve housing 4, are provided for each of the plunger arrangements 3.

The valve housing 4 has a high-pressure line 41 for each of the first control valves 5 and a low-pressure line 42 for each of the second control valves.

The high-pressure line 41 and the low-pressure line 42 are connected to the working chamber 31 of the plunger arrangement 3 at their end remote from the respective control valve 5, 6.

The valve housing 4 also has a high-pressure connection 43 that opens into the high-pressure line(s) 41 and is used to supply or discharge a fluid under high pressure.

A further fluid connection 61 is provided on each of the second control valves 6, as shown in FIGS. 1 to 3.

The at least one first control valve 5 and the at least one second control valve 6 can be actuated via a control unit 7 in such a way that a high-pressure fluid supplied via the high-pressure connection 43 of the valve housing 4 can be supplied to the working chamber 31 and can be discharged via a low-pressure connection 61 of the at least one second control valve 6 after the plunger 32 has been driven.

The at least one plunger 32 is coupled to a generator 11 via the driveshaft 9, as explained above.

The high-pressure plunger pump 2 is also characterized in that the control valves 5, 6 can be operated by the control unit 7 both as an inlet valve and as an outlet valve.

This allows the high-pressure plunger pump 2 to be operated both for energy recovery and to provide a fluid under high pressure.

The control valves 5, 6 are preferably pneumatically actuatable. It is also conceivable to actuate the control valves 5, 6 using an electric or hydraulic drive.

Equipping the high-pressure plunger pump 2 with control valves 5, 6 that can be controlled both as an inlet valve and as an outlet valve makes it possible to use a high-pressure plunger pump 2 for energy recovery.

This type of energy recovery is currently known for turbines used in hydropower or pumped storage power plants, for example, or for axial piston motors used in seawater reverse osmosis systems. These above-mentioned applications usually take place in pressure ranges of up to 100 bar.

Such pump systems are not suitable for use at higher pressures of over 200 bar.

For improved actuation of the control valves 5, 6, the control unit 7 is preferably coupled with one or more sensors, each of which provides one or more operating parameters of the high-pressure plunger pump 2, in particular the rotational position of the driveshaft 9, a pressure of a fluid in the high-pressure line 41 and/or the low-pressure line 42.

In a preferred further development, the control unit 7 also has at least one data interface for recording external operating parameter data. Such external operating parameter data is data from a process assembly upstream of the high-pressure plunger pump 2.

If the expansion of a pressurized fluid is necessary in such a process assembly, the pressurized fluid can be fed to the high-pressure plunger pump 2 via the high-pressure connection 43.

A sensor in the upstream process assembly sends a signal to the control unit 7, which then opens the control valve 5 so that the fluid under high pressure passes through the high-pressure line 41 into the working chamber 31 of the plunger 32, where it presses the plunger 32 from a compression position into an expansion position.

At the same time, the first driveshaft, which is coupled to the generator 11, is rotated so that the introduction of the fluid under high pressure into the working chamber 31 of the plunger arrangement 3 causes electricity to be generated and thus energy to be recovered in the generator.

The arrangement of a sensor, for example on the first driveshaft, further improves the control of the individual control valves 5, 6 via the control unit 7.

Thus, in a high-pressure plunger pump 2 with a plurality of plunger arrangements 3, the respective rotational position of the driveshaft 9 can be detected to determine which of the first control valves 5 is opened first after an energy recovery signal is triggered in order to pressurize precisely the one of the plungers 32 of the arrangement of several plunger arrangements 3 that is in a drive position corresponding to the optimum compression position in pump operation.

Two applications for the use of such a high-pressure plunger pump 2 are explained below.

In a first use of the high-pressure plunger pump 2 for pressure regulation in a hydraulic process assembly, the high-pressure plunger pump is coupled to the process assembly in such a way that in pumping mode, i.e. when the high-pressure plunger pump 2 is used in the classic way, the high-pressure plunger pump 2 supplies the process assembly with a fluid at a predetermined high pressure.

This is done by driving the plunger 32 by the generator 11, which can also be operated as a motor, and an energy source that drives it.

Via the low-pressure connection 61 of the second control valve 6, which in this case functions as an inlet, a fluid under low pressure is sucked into the working chamber 31 of the plunger arrangement 3 by moving the plunger 32 from a compression position into an expansion position and, with the plunger 32 subsequently driven by the external motor 10, compressed back into the displacement position and passed on to the process assembly via the high-pressure line 41 and the high-pressure connection 43, into which the high-pressure line 41 opens.

The sequence of opening and closing of the control valves 5, 6 takes place in this known manner, wherein the first control valves are connected as outlet valves and the control valves 6 as inlet valves in pumping mode.

If pressure has to be released from the hydraulic process assembly, the control valves 5, 6 of the high-pressure plunger pump 2 are switched to an energy recovery mode in which the high-pressure plunger pump 2 acts as a motor, so to speak.

In this motor operation of the high-pressure plunger pump 2, the fluid under high pressure is fed into the working chamber 31 of the plunger arrangement 3 at the predetermined high pressure via the high-pressure connection 43 and the high-pressure line 41 when the first control valve 5 is open.

This causes the plunger 32 to be driven, wherein this drive movement is transmitted to the first driveshaft 9, which in turn generates electricity in the generator 11 by coupling it to the generator 11.

In a second use of the high-pressure plunger pump 2, it serves as an expansion valve, in particular as a pressure relief valve.

In this case, the high-pressure plunger pump 2 does not function as a classic pump.

The high-pressure plunger pump 2 is inserted here as an expansion valve, so to speak, in an upstream process assembly, so that a high pressure to be discharged is fed into the high-pressure plunger pump 2 in the manner described above as motor operation of the high-pressure plunger pump 2, which effects energy recovery by generating electricity in the generator 11 via the plunger(s) 32 and the driveshaft 9.

In addition to the input parameters already described above for controlling the control unit 7, it is also conceivable to record the system pressure of the upstream process or the inlet pressure of the fluid when it enters the upstream process as control parameters.

It is also conceivable to detect the speed of the driveshaft 9, the volume flow of the fluid in the high-pressure line 41 or the low-pressure line 42.

The further embodiment variant of a high-pressure plunger pump according to the invention shown in FIGS. 4 and 5 has, in addition to the first plunger arrangement 3, a second plunger arrangement 300 with a working chamber 310 and at least one plunger 320 arranged to move axially back and forth in the working chamber 310.

Preferably, as shown in FIGS. 4 and 5, several, in particular five plungers 320 are also provided here.

As shown in FIG. 5, a pressure valve 500 and a suction valve 600 are provided for each plunger, which are connected to a valve housing 400 with a high-pressure line 410 and a low-pressure line 420.

The high-pressure line 410 is connected to the working chamber 310 by the pressure valve 500 and the low-pressure line 420 is connected to the working chamber 310 by the suction valve 600 so that it can be closed.

The at least one plunger 320 is coupled to a third driveshaft 9 via a second driveshaft, wherein the third driveshaft 9 is also coupled to the first driveshaft.

The third driveshaft 9 is preferably designed as a pinion shaft. The first and second driveshafts are preferably designed as crankshafts.

In addition to the parallel arrangement of the first plunger arrangement 3 to the second plunger arrangement 300 shown in FIGS. 4 and 5, it is also conceivable, for example, to arrange the plunger arrangements 3, 300 one behind the other.

The second plunger arrangement 300 and the associated valves are used here exclusively to increase the pressure of a working fluid, so that this area of the high-pressure plunger pump operates as a pump, with the high-pressure working fluid being available at a high-pressure connection 430 shown as an example in FIG. 4. The working fluid is fed into the high-pressure plunger pump via a low-pressure connection 700.

The energy required to operate this section is provided partially or even completely via the coupling of the three driveshafts through the other section of the high-pressure plunger pump with the first plunger arrangement and the associated control valves.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS

1 Energy recovery system
2 High-pressure plunger pump
3 Plunger arrangement
31 Working chamber
32 Plunger
4 Valve housing
41 High-pressure line
42 Low-pressure line
43 High-pressure connection
5 First control valve
6 Second control valve
61 Inlet/outlet
7 Control unit
8 Plunger housing
9 Third driveshaft
11 Generator/motor
12 Coupling
13 Frame
300 Plunger arrangement
310 Working chamber
320 Plunger
400 Valve housing
410 High-pressure line
420 Low-pressure line
430 High-pressure connection
500 Pressure valve
600 Suction valve
700 Low-pressure connection

The invention claimed is:

1. A high-pressure plunger pump comprising:
a valve housing comprising a high-pressure connection and a low-pressure connection;
a first driveshaft;
a second driveshaft;
a third driveshaft coupling the first and second driveshafts;
first and second plunger arrangements, each comprising
a working chamber;
a plunger arranged to move axially back and forth in the working chamber;
a pressure valve sealably connected, via a high-pressure line in the valve housing, to the working chamber, wherein the high-pressure line is coupled to the high-pressure connection; and
a suction valve sealably connected, via a low-pressure line in the valve housing, to the working chamber, wherein the low-pressure line is coupled to the low-pressure connection;
a control unit configured to actuate the respective pressure valves and the respective suction valves of the first and second plunger arrangements in such a way that fluid supplied via the high-pressure connection of the valve housing, and is under high pressure, is suppliable to the respective working chambers of the first and second plunger arrangements when the respective pressure valve is open and is dischargeable, via the respective suction valves, to the low-pressure connection; and
a generator coupled to the first driveshaft,
wherein the plunger of the first plunger arrangement is coupled to the first driveshaft; and
wherein the plunger of the second plunger arrangement is coupled to the second driveshaft.

2. The high-pressure plunger pump of claim 1, further comprising:
a third plunger arrangement respectively comprising a plunger, a pressure valve, and a suction valve.

3. The high-pressure plunger pump of claim 1, wherein the pressure and suction valves of the first and second plunger arrangements are operable in a regulatable manner by the control unit as both an inlet valve and an outlet valve.

4. The high-pressure plunger pump of claim 3, wherein the generator is configured to also operate as a motor.

5. The high-pressure plunger pump of claim 1, wherein the pressure and suction valves of the first and second plunger arrangements are pneumatically, electrically, or hydraulically actuatable.

6. The high-pressure plunger pump of claim 1, further comprising:
one or more sensors, each of which provides one or more operating parameter data of the high-pressure plunger pump to the control unit.

7. The high-pressure plunger pump of claim 6, wherein the one or more operating parameter data includes a rotational position of the first driveshaft, a pressure fluid in the high-pressure line, or a pressure of fluid in the low-pressure line.

8. The high-pressure plunger pump of claim 6, wherein the control unit has at least one data interface configured to record external operating parameter data of a process assembly upstream of the high-pressure plunger pump.

9. A method for operating a high-pressure plunger pump comprising a valve housing comprising a high-pressure connection and a low-pressure connection; a first driveshaft; a second driveshaft; a third driveshaft coupling the first and second driveshafts; first and second plunger arrangements, each comprising a working chamber; a plunger arranged to move axially back and forth in the working chamber; a pressure valve sealably connected, via a high-pressure line in the valve housing, to the working chamber, wherein the high-pressure line is coupled to the high-pressure connection; and a suction valve sealably connected, via a low-pressure line in the valve housing, to the working chamber, wherein the low-pressure line is coupled to the low-pressure connection; a control unit; and a generator coupled to the first driveshaft, wherein the plunger of the first plunger arrangement is coupled to the first driveshaft; and wherein the plunger of the second plunger arrangement is coupled to the second driveshaft, the method comprising:
supplying, by the high-pressure plunger pump in a pumping operation, fluid at a predetermined high pressure to a process assembly, wherein, depending on a rotational position of the first driveshaft, the pressure and suction valves of one of the first and second plunger arrangements are controlled via the control unit such that the plunger of the respective one of the first and second plunger arrangement is driven by the first driveshaft; and
supplying, by the high-pressure plunger pump in a motor operation of the high-pressure pump, fluid at the predetermined high pressure via the high-pressure line to the working chamber of one of the first and second plunger arrangements depending on the rotational position of the first driveshaft, wherein the first driveshaft is coupled to a generator to generate electricity.

10. A method for operating a high-pressure plunger pump comprising a valve housing comprising a high-pressure connection and a low-pressure connection; a first driveshaft; a second driveshaft; a third driveshaft coupling the first and second driveshafts; first and second plunger arrangements, each comprising a working chamber; a plunger arranged to move axially back and forth in the working chamber; a pressure valve sealably connected, via a high-pressure line in the valve housing, to the working chamber, wherein the high-pressure line is coupled to the high-pressure connection; and a suction valve sealably connected, via a low-pressure line in the valve housing, to the working chamber, wherein the low-pressure line is coupled to the low-pressure connection; a control unit; and a generator coupled to the first driveshaft, wherein the plunger of the first plunger arrangement is coupled to the first driveshaft; and wherein the plunger of the second plunger arrangement is coupled to the second driveshaft, the method comprising:

supplying, by the high-pressure plunger pump, high-pressure fluid from a hydraulic process assembly coupled to the high-pressure plunger pump; and controlling, by the control unit depending on a rotation position of the first driveshaft, the suction and pressure valves of the first and second plunger arrangements so that the respective plunger of the first and second plunger arrangements drives the first driveshaft, which is coupled to a generator to generate electricity.

* * * * *